US007389544B1

(12) United States Patent
Biggerstaff

(10) Patent No.: US 7,389,544 B1
(45) Date of Patent: Jun. 24, 2008

(54) ARM SHADE

(76) Inventor: James M. Biggerstaff, 600 E. 9TH St., Grove, OK (US) 74344

( * ) Notice: Subject to any disclaimer, the term of this patent is extended or adjusted under 35 U.S.C. 154(b) by 269 days.

(21) Appl. No.: 11/274,603

(22) Filed: Nov. 15, 2005

Related U.S. Application Data

(63) Continuation-in-part of application No. 10/627,133, filed on Jul. 25, 2003, now abandoned.

(51) Int. Cl.
*A41D 13/08* (2006.01)

(52) U.S. Cl. ..... 2/16

(58) Field of Classification Search ..... 2/455, 2/16, 22, 125, 124, 162, 170, 311, 910; 602/21, 602/20, 63, 64
See application file for complete search history.

(56) References Cited

U.S. PATENT DOCUMENTS

| | | | | |
|---|---|---|---|---|
| 1,147,630 | A * | 7/1915 | Hill | 2/16 |
| 2,418,887 | A * | 4/1947 | Jones | 2/162 |
| 3,942,522 | A * | 3/1976 | Kinnier Wilson | 602/6 |
| 4,183,098 | A * | 1/1980 | Knowles, Jr. | 2/16 |
| 4,677,971 | A * | 7/1987 | Lindemann | 602/21 |
| 4,977,890 | A * | 12/1990 | Mann | 602/21 |
| 5,163,678 | A * | 11/1992 | Rogers | 473/59 |
| 5,410,756 | A * | 5/1995 | Hutson | 2/459 |
| 5,450,625 | A * | 9/1995 | Hu | 2/16 |
| 5,662,594 | A * | 9/1997 | Rosenblatt | 602/16 |
| 5,715,535 | A * | 2/1998 | Hamilton et al. | 2/59 |
| 5,916,186 | A * | 6/1999 | Turto et al. | 602/20 |
| 6,076,185 | A * | 6/2000 | Schramm | 2/16 |
| 6,098,208 | A * | 8/2000 | Cordon | 2/455 |
| 6,205,583 | B1 * | 3/2001 | Beland | 2/16 |
| 6,243,867 | B1 * | 6/2001 | Faison | 2/16 |
| 6,374,408 | B1 * | 4/2002 | Tomlinson et al. | 2/22 |
| 6,405,383 | B2 * | 6/2002 | Heller et al. | 2/242 |
| 6,827,653 | B2 * | 12/2004 | Be | 473/62 |
| 6,849,056 | B1 * | 2/2005 | Wiggins et al. | 602/21 |
| 6,880,172 | B2 * | 4/2005 | Quintero | 2/16 |
| 7,081,102 | B1 * | 7/2006 | Koetter et al. | 602/21 |
| 7,188,370 | B2 * | 3/2007 | Bevier | 2/22 |

* cited by examiner

*Primary Examiner*—Alissa L Hoey
(74) *Attorney, Agent, or Firm*—James R. Head

(57) ABSTRACT

An apparatus for protecting the exposed top portion of human arms, one or both, from the sun's rays. A two piece fabric, which may have a SPF of at least 15, covers at most the top half of the arm is supported by spaced first and second elastic bands or straps, one of which encircles the wrist area and the other at the forearm forward of the elbow, leaving the forearm beneath the fabric to receive the free flow of cooling air around and under the flexible fabric portion. The two pieces are connected by adjustable hook and loop to allow for length adjustment. A swivel connection member between that portion of the piece adjacent the elbow and the second strap prevents curling or strain on the fabric when the forearm is bent about the elbow. One embodiment includes a single piece fabric with the swivel connection described.

9 Claims, 6 Drawing Sheets

ARM SHADE

CROSS REFERENCE TO RELATED APPLICATION

This is a continuation-in-part of application Ser. No. 10/627,133 filed Jul. 25, 2003 now abandoned.

FEDERALLY SPONSORED RESEARCH

There is no federally sponsored research or development.

FIELD OF THE INVENTION

The present invention relates to special solar protection garments. and, more particularly, to devices for prevention of burns or other damaging skin diseases to the forearms. The device is particularly adaptable for use by individuals who work and play in the sun.

BACKGROUND OF THE INVENTION

Most who work in the open air usually wear short sleeves shirts leaving the forearms exposed. One of the basic problems confronting those who work, or play with their forearms exposed, is sunburn or the possibility of other skin diseases caused by the sun's rays. On the other hand it is also desirable to keep the arms as cool as possible.

Within just five minutes on a sunny summer day one's skin may absorb enough UV radiation to develop a minor sunburn. Skin cells may suffer injury that can not be seen or felt. Multiply that over the years and damage from daily sun exposure may become major, including skin cancer and skin aging. In recent years, the public has become more aware of the effects of melanoma and the prevention and treatment thereof.

There are two types of ultraviolet rays-UVA (long wave solar rays of 320-400 nanometers) and UVB (short wave solar rays of 290-320 nanometers)—that can affect the skin even with small daily doses. The UVB rays are most abundant in the midday sun, usually from 10 a.m. to 4 p.m., when your shadow is shorter than a person, and are most associated with sunburn. The medical community, recommends full head-to-toe protection of at least SPF (Sun Protection Factor) of 15, and preferably 30+. SPF or UPF (Ultra Violet Protection Factor) is meant to be a guide of how much time you can spend in the sun compared to how long the skin takes to redden without protection. Liquid sun screens, although effective, are troublesome to use and are not always effective against harmful UVA radiation. It is known that most people don't apply the recommended doses of sun screen and/or don't like the mess. For more information refer to the Internet at <www.skincancer.org>.

A UV blocking fabric is found in U.S. Pat. No. 6,037,280.

Others have tried to seek protection of their arms by tubular sleeves that surround the arm and in some instances up to and including the shoulder. Some representative samples of such garments can be found in the following U.S. patents:

U.S. Pat. No. 5,357,633 Rael; U.S. Pat. No. 5,628,062 Tseng; U.S. Pat. No. 5,974,586 Reinoso; and U.S. Pat. No. 6,539,550 Flores.

However, these devices, although they teach sun protective concepts, are tubular in construction being designed to fully cover the arm and in the instance of the Rael, Flores and Reinoso to include the upper arm and shoulder. Such devices would not be comfortable in the heat of summer as there is no free flow of air around the exposed limbs.

Other forms of devices to protect the arms and/or shoulders for different, or unexplained, reasons are found in the following U.S. patents U.S. Pat. No. 1,141,656 Rosenbaum, et al.; U.S. Pat. No. 1,157,341 Tallerday; U.S. Pat. No. 5,511,241 Ziegler; U.S. Pat. No. 5,734,992 Ross; U.S. Pat. No. 6,405,381 Bowman, Jr.; U.S. Pat. No. 6,449,772 Donner; and U.S. Pat. No. 6,472,590 Kulik.

There are in the prior art devices for partially covering the arm as shown in the following U.S. patents:

U.S. Pat. No. 794,294 Gardner; U.S. Pat. No. 925,952 Sacks; U.S. Pat. No. 5,056,157 Pryor; and U.S. Pat. No. 6,243,867 Faison Gardner and Sacks describe devices for protecting the underside of sleeve covered arms such as during indoor desk work.

The Pryor and Faison patents describe devices for protecting the upper forearm from solar radiation, but like the prior art utilizes a plurality of VELCRO straps to releasably secure the fabric. To permit free flow of air, as when the arm is outside the window of a vehicle, these straps must be loose fitting which could allow the device to move about the arm. To prevent that, the straps must then be tight around the arm, which then will restricting the free flow of air around the arm.

One problem with certain prior art devices is that when the forearm is pivoted about the elbow joint, as for example, moved upward and/or inward, the covering becomes unattractive as it moves, twists or curls, and exposes the forearm. The use of a swivel connection means adjacent the elbow joint, as disclosed herein, prevents such moving or twisting of the protective covering.

Although protecting the arm which projects outwardly of a vehicle is still possible, the modern day vehicle is usually air cooled with the windows closed. There are, however, many other situations where protection is needed. Construction laborers, service personnel, and even those who work and attend outdoor sports or other events could use protective devices.

It is therefore an object of the invention to provide a garment device for protecting one or both forearms of individuals from the harmful effects of the sun.

It is another object of the invention to provide a device that not only protects the forearm of individuals but is comfortable and cooler. The distinctive feature being a length, or an adjustable length, of flexible sun blocking fabric that is loosely fitted over at least the top portion of the forearm between two elastic bands or adjustable straps, one at the wrist, the other forward of the elbow joint and bone.

Another object of the invention is the use of a medically acceptable fabric providing high SPF, UVA and UVB sun protection such as that sold under the trademark SOLUMBRA, a product of Sun Precautions, Inc. Other fabrics of Solar Protective Factory, Inc sold under the trademarks SOLARWEAVE and SUN RePel are inclusive of use. Such fabrics are advertised to provide 30+ SPF protection.

A further object of the invention is to provide a fabric covering that includes ornamental designs or promotional advertising on the outside.

SUMMARY OF THE INVENTION

In accordance with the present invention, there is provided an apparatus for protecting one or both of the exposed top portion of a human forearm from the sun's rays. A piece of flexible fabric, preferably, but not limited to, a sun blocking material of at least SPF of 15. The fabric covering at least or at most the top half of the arm is supported by spaced first and second elastic bands or adjustable straps. The first band or strap encircles the Ulna or wrist area, herein "wrist strap." The second band or strap encircles the forearm adjacent and forward of the elbow joint, herein "elbow strap", leaving that portion of the forearm beneath the flexible fabric to receive the unobstructed free flow of air around and under the flexible fabric portion and without twisting or turning of the fabric when the forearm is pivoted about the elbow joint. Adjustable straps can be connected by hook and loop, e.g., Velcro®, means.

Another aspect of the invention is where the outside of the flexible fabric may contain informational indicia, ornamental designs, or even advertising, such as, but not limited to, goods, services, school or university colors, emblems or expressions, and the like.

To prevent curling or abnormal strain on the fabric when the forearm is bent about the elbow, the invention includes a swivel connection below the rear portion of the sleeve.

In one embodiment the sleeve is formed of a forward sleeve portion and a separate rear sleeve portion. The forward and rear portions are adjustably connected to change the length of the overall sleeve for different forearm lengths, e.g. for children and adults. A hook and loop connection is one form of adjustment means, although well known snaps or buttons as taught in U.S. Pat. No. 1,349,359 are inclusive of the invention. A wrist strap is found at the forward end of the forward portion.

The aforementioned swivel member is located below the rearward end of the rear sleeve. A forward portion of the swivel member is rotatably connected to a first pivot member attached to the material of said rear portion. A buckle is rotatably connected about a second pivot at the rear portion of the swivel member. A hook and loop elbow strap is connected to the buckle.

In another embodiment, the arm shade of this invention is a sleeve of width to cover at least the top half of a human forearm. The sleeve is formed of a length of material or cloth that extends forwardly from the elbow joint to the wrist of a human forearm. A wrist strap is connected to the forwardmost end of the sleeve. A swivel member, as described above, is located below the rearward end of the rear sleeve portion.

DETAILED DESCRIPTION OF THE INVENTION

Figure 1:
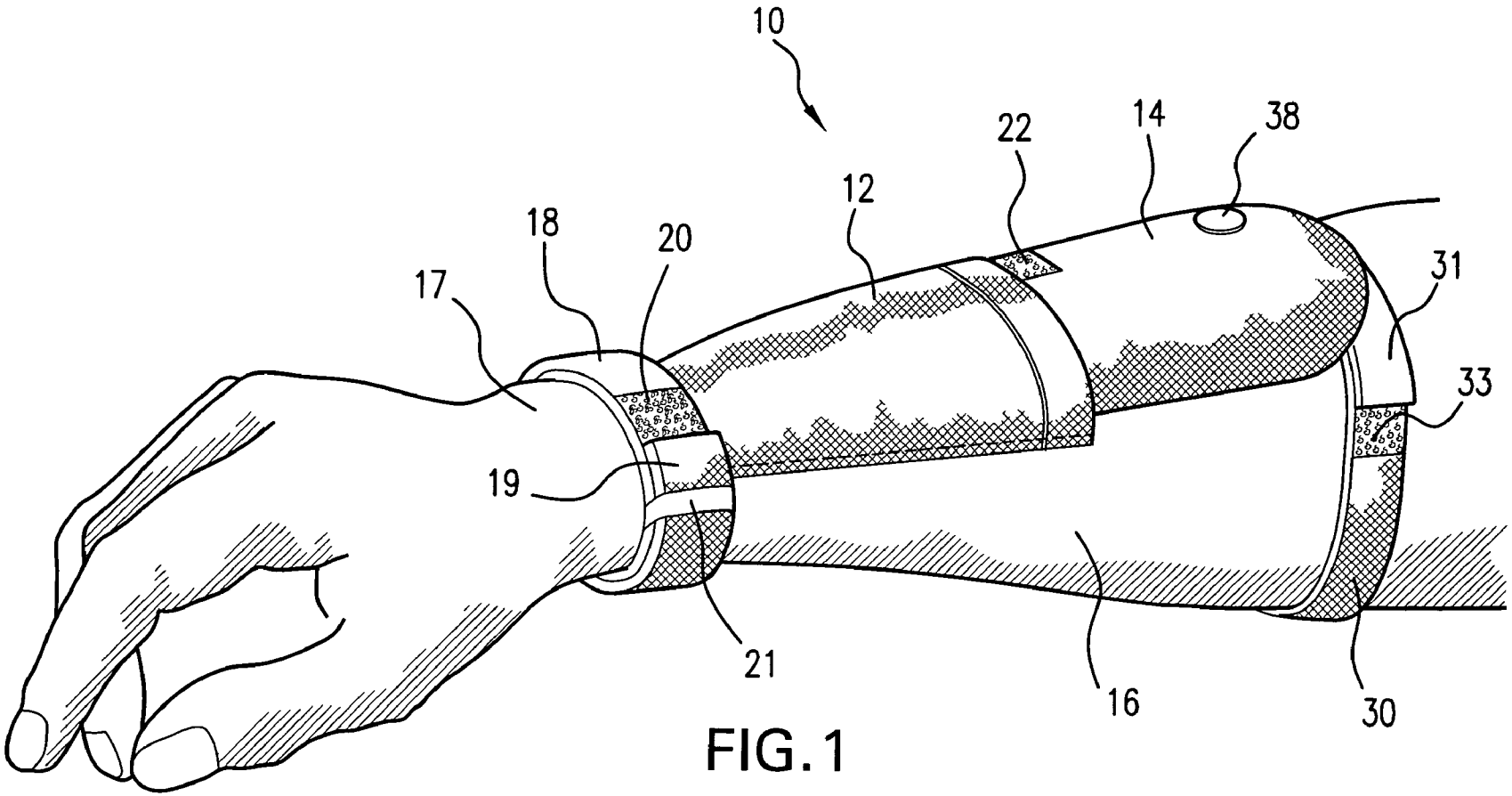
FIG. 1 is a perspective view of the two piece arm shade of this invention on the forearm of a person.
Figure 2:
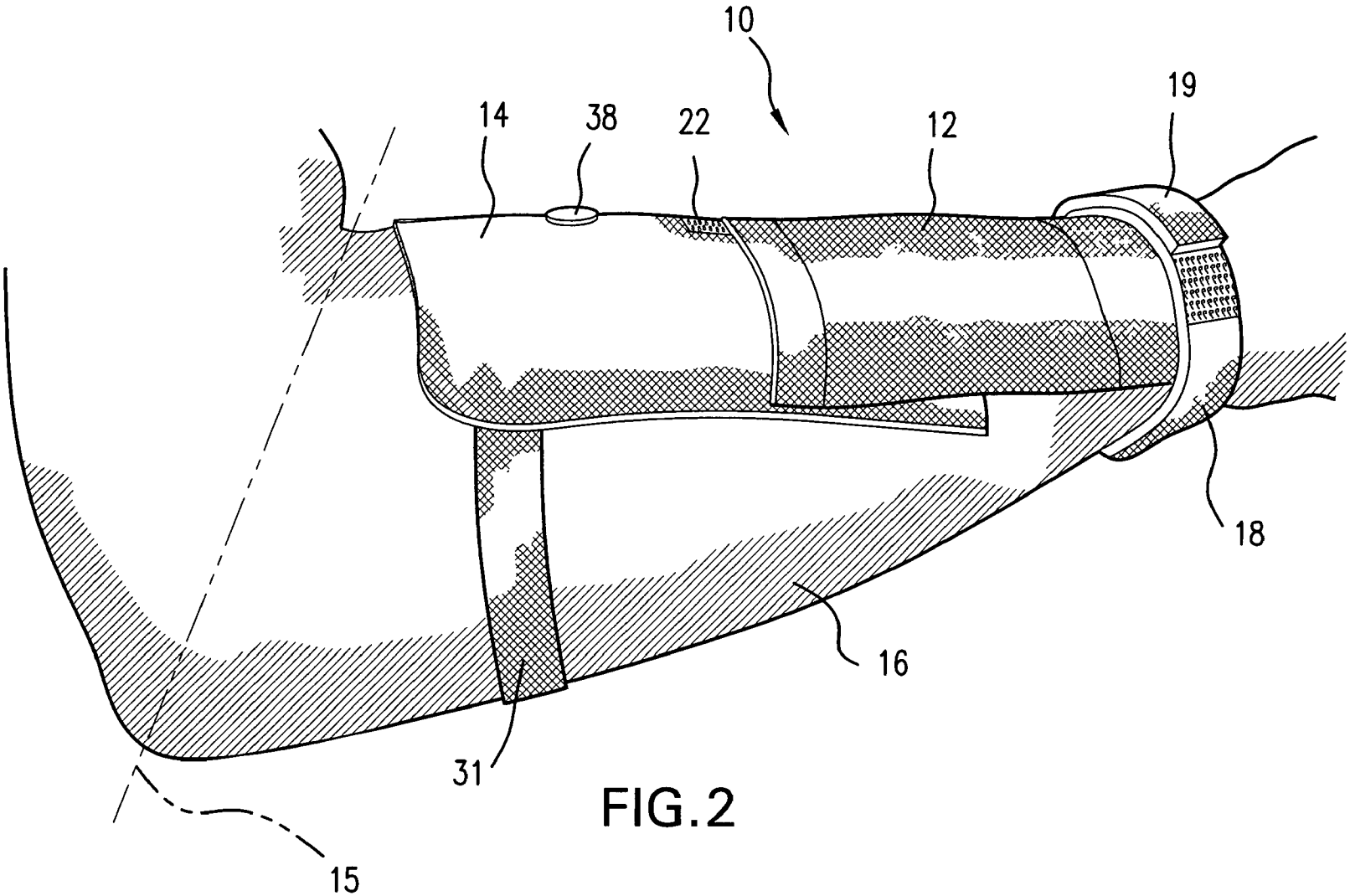
FIG. 2 is a perspective side view of the two piece arm shade when the forearm when the arm is bent about the elbow joint.
Figure 3:
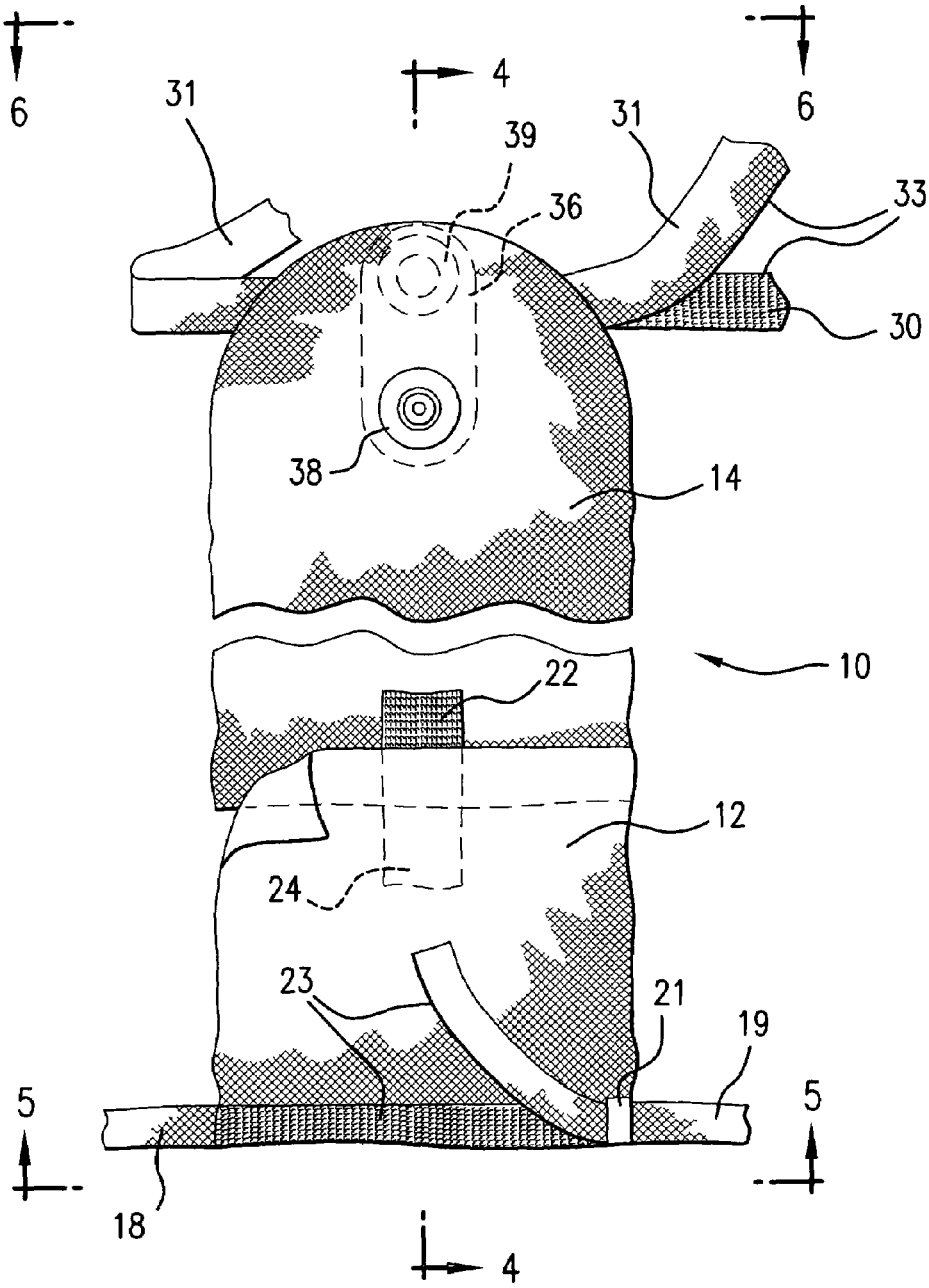
FIG. 3 is a top plan view of the two piece arm shade invention.
Figure 4:
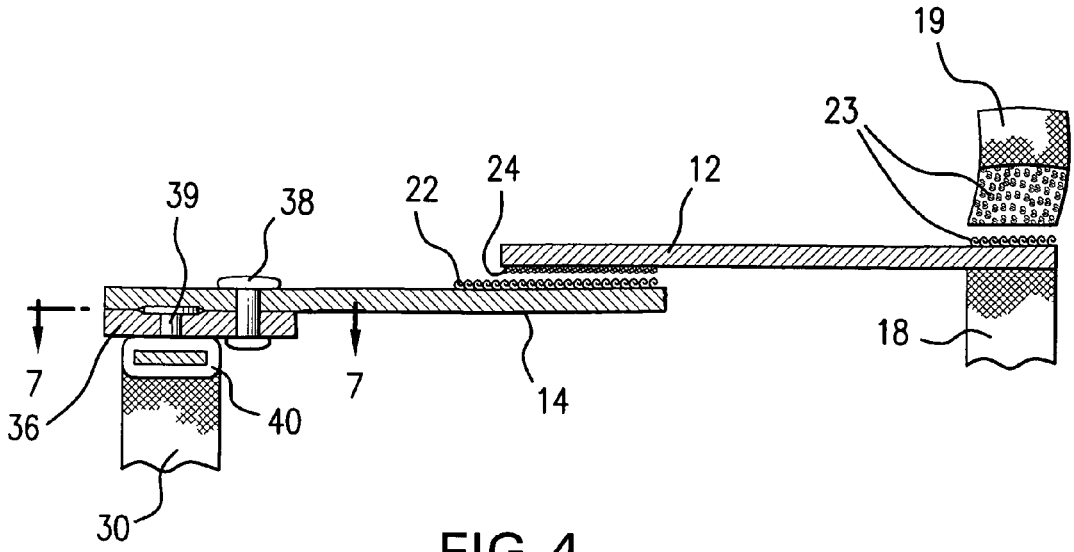
FIG. 4 is a sectional view taken along the line 4-4 of FIG. 3.
Figure 7:
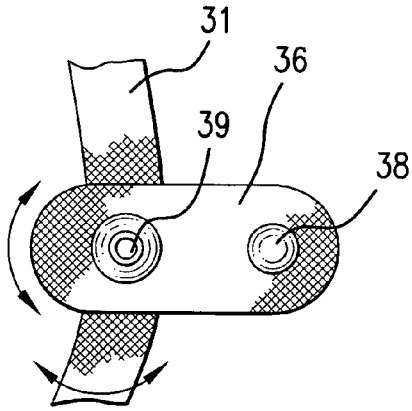
FIG. 7 is a sectional view taken along the line 7-7 of FIG. 4.
Figure 5:
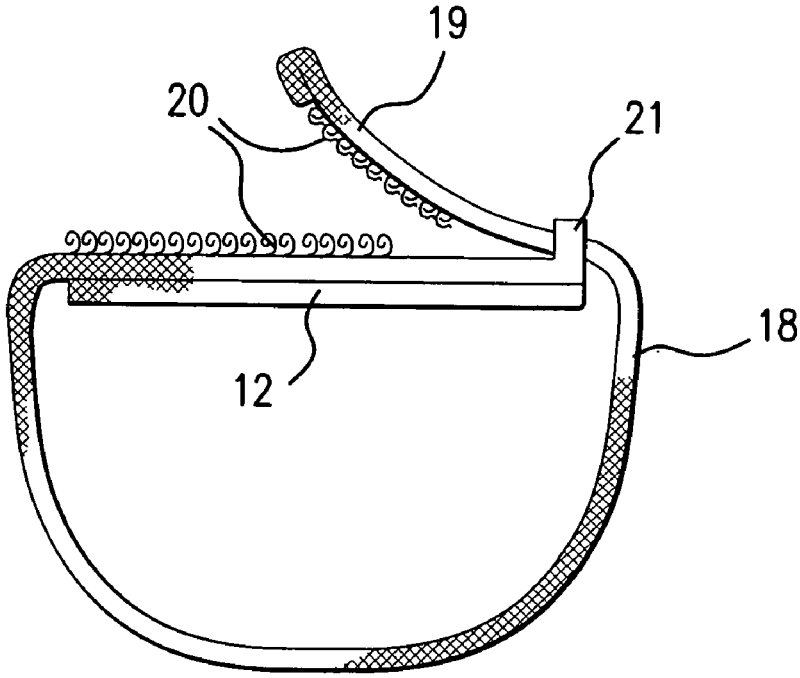
FIG. 5 is a sectional view taken along the line 5-5 of FIG. 3.

Referring to the FIGS. 1-7, where like numerals represent like parts. As used herein, the term "forward" or "forwardly" indicates a direction from the elbow joint 15 to the wrist area 17 of a human forearm. The protective arm shade invention is generally indicated by the numeral 10, and comprises forward portion 12 and rear portion 14. Each portion is comprised of a single piece of cloth or like material. The assembly extends forwardly from the pivotal elbow joint 15. The forward portion 12 is retained to the forearm wrist area of arm 16 by wrist strap 18. A tag end 19 of strap 18, slips through buckle 21 and is retained to the strap 18 by adjustable hook and loop means 23, e.g., Velcro®.

To permit adjustment for comfort and or varying lengths of the human forearm, the forward portion 12 is retained to the rear sleeve 14 by hook and loop means 22 and 24. See FIG. 4. The means 22 and 24 can be axial, as shown, or extend transversely, not shown, but well within the knowledge of a man skilled in the art.

Figure 6:
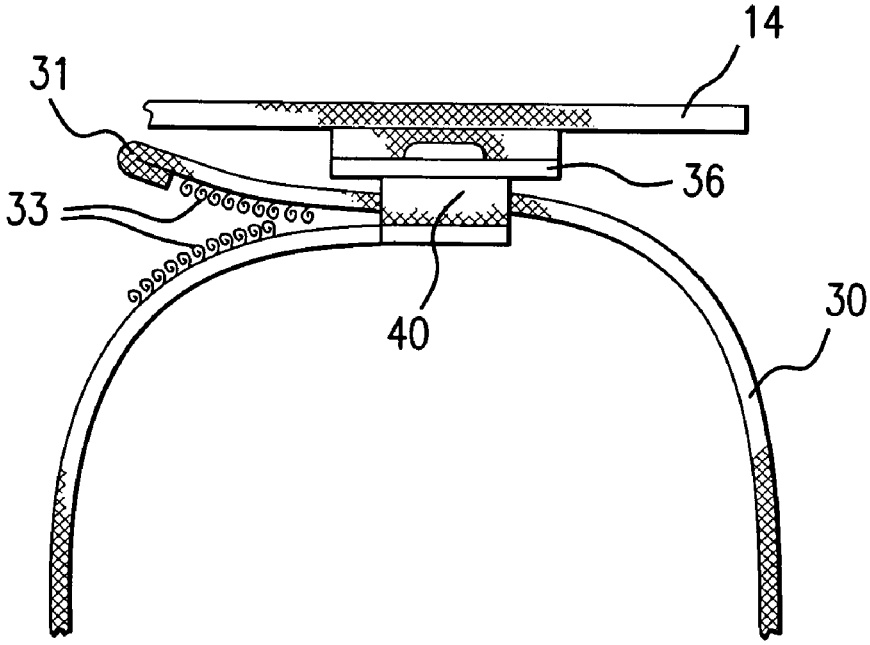
FIG. 6 is a sectional view taken along the line 6-6 of FIG. 3.

A rear portion 14 is retained by hook and loop strap 30 via a swivel connection member 36 situated below the rear portion and is best shown in FIGS. 3, 4, 6 and 7. A forward part of the flexible swivel connection member 36 is rotatably connected below the rearward portion 14 by a first pivot member 38, such as a dungaree button or rivet-like member. A loop or buckle 40 is retained to a rear part of the swivel connection member 36 via a second pivot member 39. One end of strap 30 is retained to the buckle 40 while a tag end 31 will slip through the buckle 40 as shown in FIG. 6. The tag end 31 is retained to strap 30 using hook and loop means 33.

Figure 8:
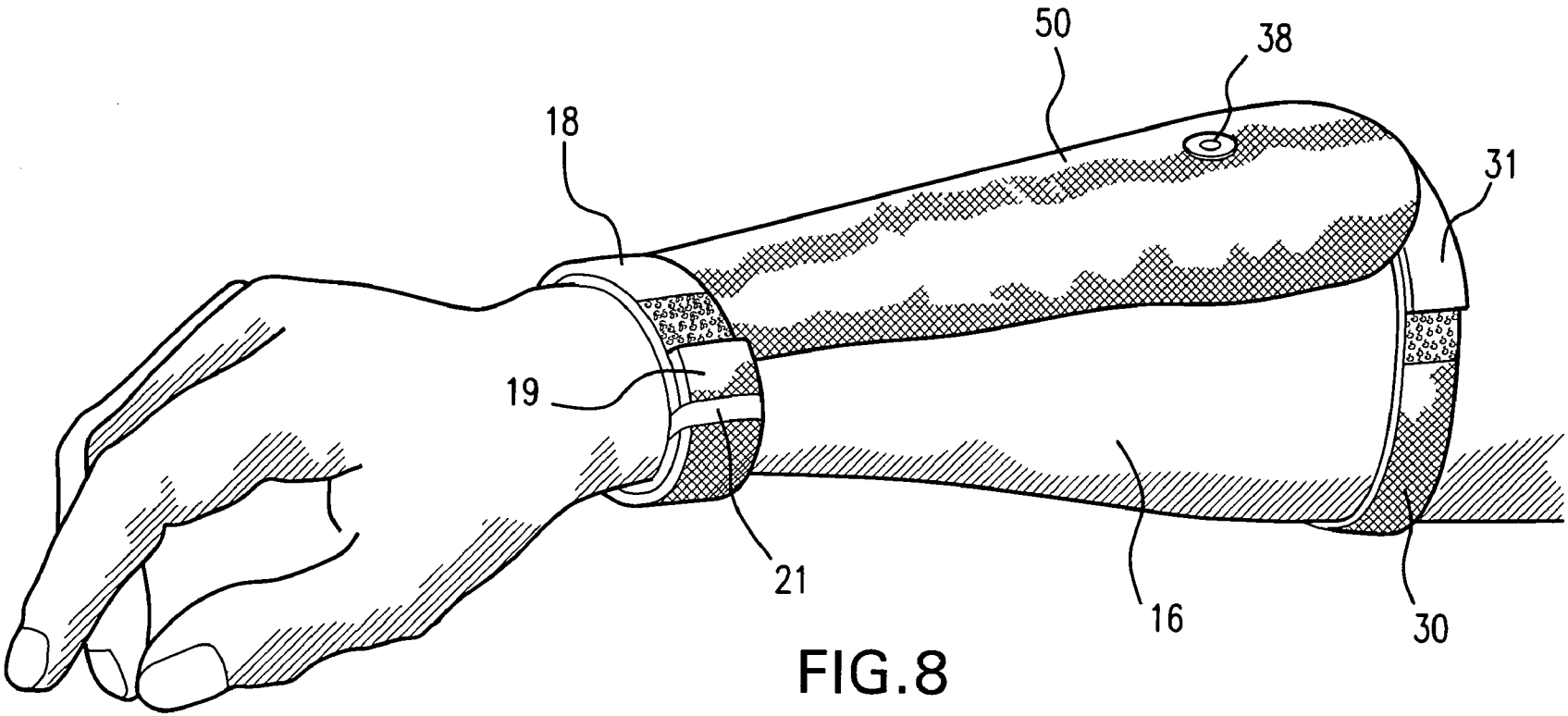
FIG. 8 is an alternate embodiment of the invention.

FIG. 8 represents an alternate embodiment wherein a single flexible material 50 is in lieu of the two piece, forward and rear portions embodiment shown in FIGS. 1-7. The embodiment uses the same swivel connection concept as disclosed in the prior figures.

Although the material used with the arm shade is preferably a single piece of cloth, other materials which meet the purposes of the invention are inclusive of the invention.

The invention claimed is:

1. An arm shade for covering a portion of a human forearm from an elbow joint forwardly to a wrist, said shade comprising:

a forward portion;

a rear portion;

said forward portion and said rear portion are each made of a single piece of flexible cloth;

adjustable means connecting said forward portion to said rear portion to adjust the overall length of said arm shade;

a wrist strap at a forward end of said forward portion;

a swivel member comprised of a single piece of material, positioned beneath a rearward end of said rear portion, a forward portion of said swivel member rotatably connected about a first pivot member;

said first pivot member connecting said rear portion and said swivel member at the center of said rear portion;

a buckle rotatably connected about a second pivot adjacent a rear portion of said swivel member; and an elbow strap connected to said buckle.

2. An arm shade according to claim 1 wherein said adjustable means is a releasable hook and loop.

3. An arm shade according to claim 1 wherein said wrist strap is an elastic band.

4. An arm shade according to claim 1 wherein said elbow strap is an elastic band.

5. An arm shade according to claim 1 wherein said wrist strap and said elbow strap are adjustable bands, each having tag ends with hook and loop connectors.

6. An arm shade for axially covering a portion of a human forearm from an elbow joint forwardly to a wrist, said shade comprising:

a single piece of flexible cloth material extending forwardly from said elbow joint to said wrist;

a wrist strap adjacent a forward most end of said material;

a swivel member, comprised of a single piece of material, positioned beneath a rearward end of said material, a forward portion of said swivel member rotatably connected about a first pivot member;

said first pivot member connecting said rear portion and said swivel member at the center of said rear portion;

a buckle rotatably connected about a second pivot adjacent a rear portion of said swivel member; and an elbow strap connected to said buckle.

7. An arm shade according to claim 6 wherein said wrist strap is an elastic band.

8. An arm shade according to claim 6 wherein said elbow strap is an elastic band.

9. An arm shade according to claim 6 wherein said wrist strap and said elbow strap are adjustable bands, each having tag ends with hook and loop connectors.

* * * * *